United States Patent [19]

de Waal Malefijt et al.

[11] Patent Number: 4,768,685

[45] Date of Patent: Sep. 6; 1988

[54] METALLURGICAL VESSEL AND ADJUSTMENT DEVICE

[75] Inventors: Jacobus A. de Waal Malefijt, Haarlem; Cornelis Haringhuizen, Heiloo, both of Netherlands

[73] Assignee: Hoogovens Groep B.V., Ijmuiden, Netherlands

[21] Appl. No.: 916,240

[22] Filed: Oct. 7, 1986

[30] Foreign Application Priority Data

Oct. 9, 1985 [NL] Netherlands ..... 8502748

[51] Int. Cl.[4] ..... B22D 41/08

[52] U.S. Cl. ..... 222/600; 222/504; 266/236; 251/98; 251/291

[58] Field of Search ..... 222/601, 600, 504; 266/236, 271; 251/291, 62, 48, 95; 92/165 PR

[56] References Cited

U.S. PATENT DOCUMENTS

| | | | |
|---|---|---|---|
| 2,596,532 | 5/1952 | Coolidge et al. | 251/291 X |
| 3,503,244 | 3/1970 | Joslin | 24/517 X |
| 3,558,256 | 1/1971 | Bick et al. | 222/600 X |
| 3,764,042 | 10/1973 | Shapland et al. | 222/600 X |
| 4,596,345 | 6/1986 | Beckers | 222/600 |

FOREIGN PATENT DOCUMENTS

| | | | |
|---|---|---|---|
| 0147176 | 12/1978 | Japan | 92/165 PR |
| 0209756 | 12/1982 | Japan | 222/600 |
| 0925550 | 5/1982 | U.S.S.R. | 222/600 |

*Primary Examiner*—Joseph J. Rolla
*Assistant Examiner*—Nils E. Pedersen
*Attorney, Agent, or Firm*—Stevens, Davis, Miller & Mosher

[57] ABSTRACT

A metallurgical vessel such as a tundish fitted with a slide gate at its underside for discharging its contents has the slide gate controlled by a drive that can be removed to another vessel when required. The drive comprises a hydraulic cylinder with a drive rod projecting from it and carrying a coupling releasably engageable with the slide gate. The cylinder and drive rod are clamped non-rotatably in use but when attaching or removing the drive they can be rotated about a common longitudinal axis to alternative angular positions in which the slide gate is coupled or uncoupled thereto. Changeover of the drive can be made quickly thereby. A double-ended drive constructed in this manner can be used with vessels having two controllable outflow devices and provides for an equally quick changeover.

11 Claims, 3 Drawing Sheets

METALLURGICAL VESSEL AND ADJUSTMENT DEVICE

BACKGROUND OF THE INVENTION

The invention relates to a metallurgical vessel having on its underside an adjustable outflow device, for example a tundish, for a continuous casting machine with a slide gate, which outflow device is connected to a drive device via a coupling and a drive rod in the driving direction.

The invention also concerns a removable adjustment device comprising a drive means, a drive rod and a coupling, which may be used in vessels provided with an adjustable outflow device and which are intended to be mobile.

Metallurgical vessels with an adjustable outflow device on their underside are employed frequently in the steel industry (see, e.g. GB No. 1477173). An example is the tundish of a continuous casting machine, from which a nozzle projects into a mould. The outflow through this nozzle is controlled by a slide gate. Such a tundish is designed to be mobile as it must be possible for casting to continue with a replacement tundish when for example the tundish has to be repaired. The frequency with which a tundish has to be replaced depends on the casting cycle.

Usually three to four ladles of steel to be cast are emptied into the tundish, and after casting is completed and the tundish has had any remaining steel and slag emptied out of it, it is replaced. Sometimes the tundish is replaced after one charge, that is after the contents of one ladle have been cast. The quality of the lining and the outflow openings of the tundish used for casting are then checked.

For these methods of operation it is necessary to have a number of tundishes in circulation, with it being necessary for them to be replaced quickly because of the need to maintain the required production capacity of the casting machine.

The slide gate fitted on the underside of the tundish is connected via a drive rod in the driving direction to a drive device, such as a hydraulic cylinder. Tundishes which include a hydraulic cylinder can be replaced rapidly as only the hydraulic supply and discharge lines have to be disconnected or connected. This does, however, have the disadvantage that oil from the hydraulic system can get onto the casting platform, which increases the risk of fire. In addition, the hydraulic system must be vented at regular intervals, and dirt can enter the system, which causes oil leaks.

In U.S. Pat. No. 4,042,207 a casting ladle or tundish is disclosed with a slide gate permanently secured to its underside but a removable hydraulic cylinder drive for adjusting the slide gate. In this way the disadvantages of having to disconnect the hydraulic lines are avoided, but the manner of attachment of the slide gate adjustment device is not suited for fast and secure operation. The hydraulic cylinder is hooked onto lugs projecting from the slide gate and it is then necessary to manipulate the piston rod projecting from it (it is suggested that both axial and rotational movements of the rod may be required) in order to couple the rod drivingly with a moveable part of the slide gate. Even after this series of operations the adjustment device is not positively secured to the tundish or the slide gate; it relies on its own weight providing a stabilising force to hold it in position.

SUMMARY OF THE INVENTION

In one of its aspects, the invention provides a vessel having a holder fixed to its underside which may be swung open to receive a removable drive device which comprises a drive rod rotatable about its longitudinal axis, by means of which the coupling connected to a projecting end of the drive rod can be released and fixed.

In another of its aspects, the invention provides the advantage of such an arrangement, that the conversion of the drive from one tundish to the next can be carried out very quickly, is particularly important in the cases of so-called twin casting. In twin casting two nozzles are present in one mould, from which steel is brought from the tundish into the mould. For each nozzle a slide gate with drive is provided, by means of which the steel stream can be controlled. The number of drives to be replaced and the time needed for this is double that of normal casting. The assembly of the present invention and associated dismantling technique is particularly valuable in twin casting for maintaining a high production capacity of the continuous casting machine.

Preferably the drive device is of a double-headed design with two drive rods and two couplings, each of which is connected to one outflow device. An important advantage is that the assembly and dismantling time is not very different from that in normal casting, as the number of drives to be changed is equal to the number of drives in normal casting. Further, the double-headed design of drive device makes effective use of the limited space under the tundish, where there is not room for extra drives.

It is preferable for the two drive rods to be coupled in their direction of rotation so that the couplings of both drive rods can be loosened or tightened at the same time.

It is further preferable for the drive rod to have a pawl or other projection by means of which the drive rod can be rotated, and a guide to engage the pawl and thereby block the rotary movement of the drive rod. By this means the coupling which turns with the drive rod is quickly interlocked.

In a preferred embodiment the drive device is in the form of a cylinder, and a driven element fitting in the cylinder has a fixed connection to the drive rod. Consequently the drive rod does not have to be loosened from the driven element, and it is not necessary to use another construction where the drive rod can rotate without the drive device having to rotate at the same time. In this preferred embodiment the driven element is connected non-rotatably to the drive rod and the drive rod can be rotated by turning the driven element in the cylinder.

In another preferred feature the inner wall of the cylinder has a key or key-way running in the longitudinal direction, and the driven element has a recess or protruberance, respectively, mating therewith. These mating elements then act as a positive connection between the cylinder and the driven element. Thus, after positioning the cylinder in the holder, the cylinder can be rotated, for example by a handle fixed to it, as a result of which the drive rod is also rotated and the coupling is interlocked.

The leakage which usually occurs with a hydraulic cylinder having a key or key-way is in this case an advantage as the leakage oil carries away excess heat at the underside of the tundish.

It is preferable for the holder to be operable by having a movable part hinged on one side to a fixed part of the holder and fixed by a clamp on the other side of the fixed part of the holder, which clamp is connected for swivelling on the fixed part of the holder. By this means the coupling of the slide gate drive for a new tundish can be carried out by means of four operations, namely:

a. hanging the drive in the holder b. driving out the piston until the portion of the coupling connected to the drive rod engages the portion of the coupling which is connected with the outflow device.

c. turning the drive until the coupling is secured.

d. interlocking the coupling by securing the clamp.

BRIEF DESCRIPTION OF THE DRAWINGS

A preferred embodiment of the invention will now be described by way of non-limitative example with reference to the accompanying drawings in which.

DESCRIPTION OF THE PREFERRED EMBODIMENT

Figure 1:
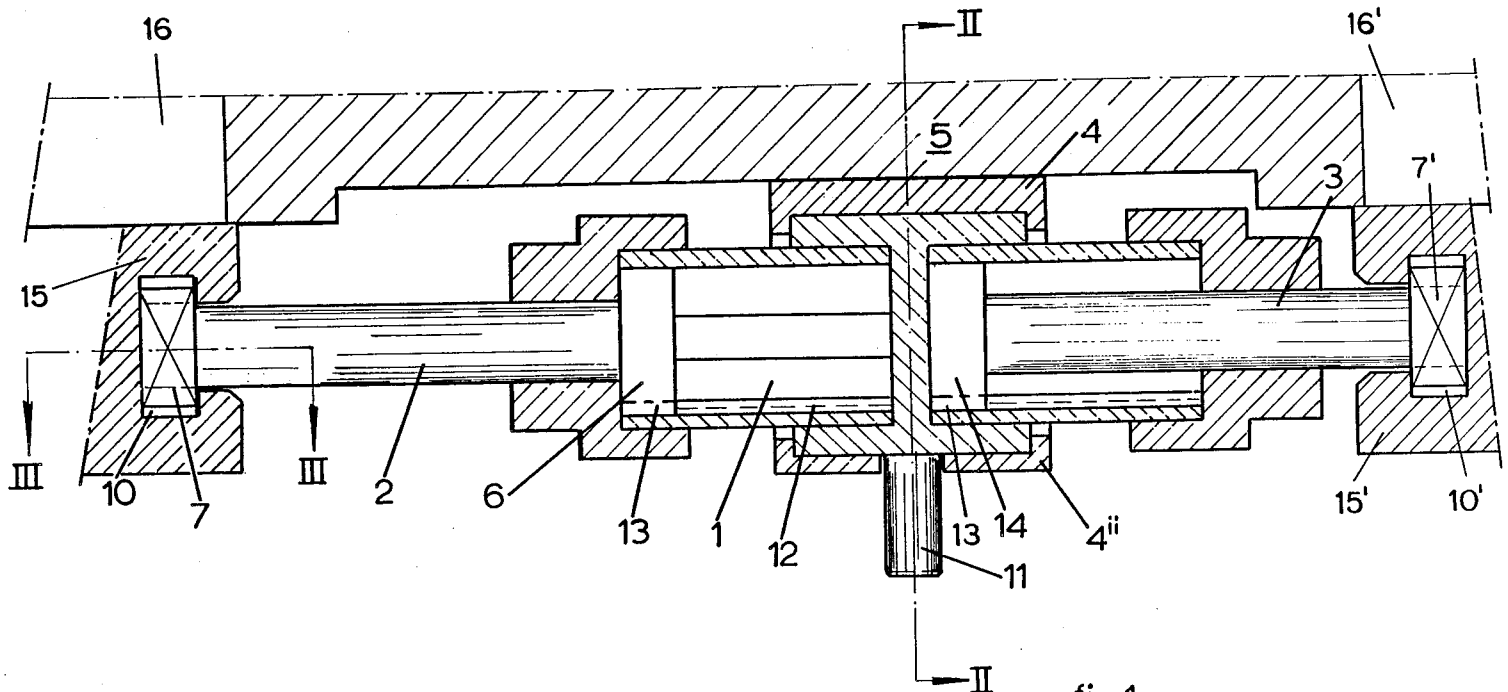
FIG. 1 shows a drive device, the drive rods mating with it and one of the associated couplings which is secured to a slide gate.

FIG. 1 shows as the drive device a hydraulic cylinder 1 which is of a double-sided design with two opposite drive rods 2 and 3.

The hydraulic cylinder 1 can be suspended from a holder 4 which is fixed to the underside of a tundish 5. One end of drive rod 2 is fixed to the hydraulic cylinder 1 by piston 6, and the other end to coupling 7. By turning coupling 7 it can be secured. A similar design is provided for drive rod 3.

Figure 2:
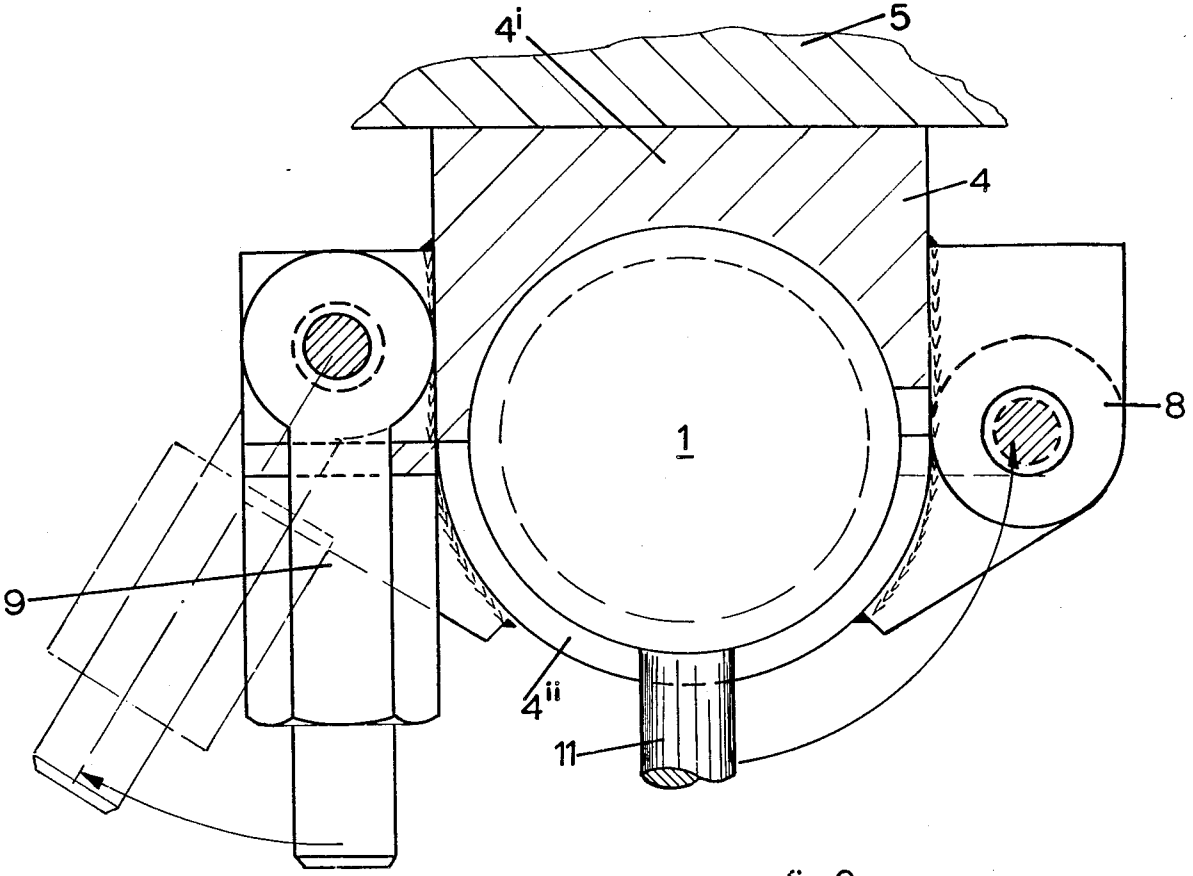
FIG. 2 is a cross-section through the drive device on line II—II in FIG. 1.

In practice, mounting of the adjustment device is carried out as follows:

Holder 4 (FIG. 2) consists of a fixed part $4^{i}$ and a movable part $4^{ii}$. The movable part $4^{ii}$ is attached on one side with a hinge 8 to the fixed part $4^{i}$. On the other side both parts are coupled together with a clamp 9 which can be swung aside.

Figure 3:
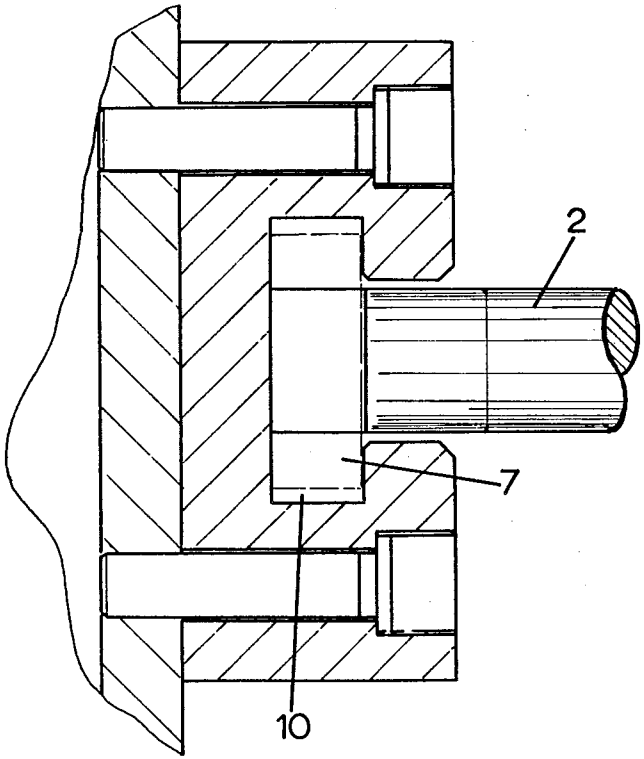
FIG. 3 shows the fixing of the coupling to the slide gate in a cross-section on line III—III in FIG. 1, in the unsecured state.

After undoing and swinging aside clamp 9, the movable part $4^{ii}$ of holder 4 is swung open and the hydraulic cylinder 1 of the adjustment device is hung in holder 4. When positioning the hydraulic cylinder 1, pistons 6 and 14 are retracted. After suspending the hydraulic cylinder 1 in the holder 4, the pistons 6 and 14 are extended until coupling 7 engages slot 10 (see FIG. 3) of the slide gate 15 closing opening 16. The same applies for the coupling and slot at the end of the drive rod 3.

A handle 11 attached to hydraulic cylinder enables cylinder 1 to be rotated in holder 4. The cylinder 1 has a key 12 fixed to its inside face, and pistons 6 and 14 each have a key-way 13 into which the key fits. Because of the connection so formed, the rotation of cylinder 1 is transmitted to drive rod 2 and coupling 7 to secure coupling 7 secured in slot 10, and simultaneously the coupling which is connected to drive rod 3 is secured in its associated slot 10. The drive rods 2 and 3 are thereby axially coupled to their slide gates 15, 15'.

Then the movable part $4^{ii}$ of holder 4 is gripped against the fixed part $4^{i}$ by tightening clamp 9. As a result coupling 7 is interlocked in slot 10, and likewise for the coupling connected to drive rod 3, until they are released again by reversing the procedure.

The device is now ready for simultaneously operating the slide gates coupled to the drive rods 2 and 3. This situation is shown in FIG. 1.

We claim:

1. A metallurgical vessel having an underside, an adjustable outflow means on said underside for the contents of said vessel, drive means for adjusting said outflow means, and means at said underside of said vessel for holding said drive means, said holding means comprising engagement and release means for releasably securing said drive means, at least one drive rod for connecting said drive means to said outflow means, a releasable coupling between said drive rod and said outflow means for linking said outflow means and said drive means in a driving direction longitudinally of said drive rod, and means for rotating the drive rod about its longitudinal axis for releasing and engaging said coupling with said outflow means, said holding means comprising a part fixed to the vessel and a part displaceable thereto, said displaceable part having one side hinged to said fixed part, and said engagement and release means comprises a clamp having a pivot connection on said fixed part and engaging the displaceable part remote from said one side to clamp the drive means in place.

2. The vessel according to claim 1 wherein the drive means defines a cylinder, a driven element fitting in said cylinder and a fixed connection between said driven element and the drive rod.

3. The vessel according to claim 2 wherein said cylinder is provided with a key running in the longitudinal direction of the cylinder and said driven element is provided with a key-way running in the longitudinal direction of the cylinder, said key-way of said driven element sliding on said key of said cylinder.

4. The vessel according to claim 1 wherein said means for rotating said drive rod comprises a handle mounted on said cylinder.

5. An adjustable device for use with a metallurgical vessel having an adjustable outflow means on its underside, said device comprising a drive means including a cylinder, at least one drive rod and a coupling connected to the drive means through said drive rod for displacement of said coupling in a drive direction by said drive means, and means to rotate said coupling, drive rod and cylinder about an axis extending in said drive direction after contact of the coupling with said outflow means to secure said coupling to and release said coupling from said adjustable outflow means, said means for rotating said drive rod and said cylinder comprises a handle mounted on said cylinder.

6. The adjustment device according to claim 5, comprising a double-sided drive means with two said drive rods and respective coupling on said drive rods for which each can be connected to adjustable outflow means.

7. The adjustment device according to claim 6 wherein the two drive rods are coupled together non-rotatably.

8. The adjustment device according to claim 5 wherein said a cylinder encloses a driven element fitting in said cylinder and a fixed connection between said driven element and said drive rod.

9. The adjustment device according to claim 8, wherein said cylinder is provided with a key running in the longitudinal direction of the cylinder and said driven element is provided with a key-way running in the longitudinal direction of said cylinder, said key-way of said driven element sliding on said key of said cyinder.

10. A metallurgical vessel having an underside, two adjustable outflow means on said underside for the contents of said vessel, double-headed drive means for adjusting said outflow means, and means at said underside of said vessel for holding said drive means, said holding means comprising engagement and release means for releasably securing said drive means, two drive rods for connecting said drive means to said outflow means, a releasable coupling between each said drive rod and each said outflow means for linking said two outflow means and said double-headed drive means in a driving direction longitudinally of said drive rods, and means for rotating the drive rods about their longitudinal axis for releasing and engaging each said coupling with said outflow means.

11. The vessel according to claim 10 including means to couple said rods wherein said drive rods are coupled together for rotation about an axis extending in their longitudinal direction.

* * * * *